US007401370B2

(12) United States Patent
McClintock

(10) Patent No.: US 7,401,370 B2
(45) Date of Patent: Jul. 22, 2008

(54) SELF-STORING AIRBED

(75) Inventor: Jason McClintock, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 76 days.

(21) Appl. No.: 11/126,449

(22) Filed: May 11, 2005

(65) Prior Publication Data

US 2006/0253991 A1 Nov. 16, 2006

(51) Int. Cl.
*A47C 27/08* (2006.01)

(52) U.S. Cl. ..... 5/706; 5/654

(58) Field of Classification Search ..... 5/413 AM, 5/70, 653–654

See application file for complete search history.

(56) References Cited

U.S. PATENT DOCUMENTS

| | | | | |
|---|---|---|---|---|
| 814,654 | A | 3/1906 | Kee | |
| 877,568 | A | 1/1908 | Innes | |
| 1,002,006 | A | 8/1911 | Stapely | |
| 1,549,289 | A | 8/1925 | Bradley | |
| 1,704,182 | A | 3/1929 | Ellery | |
| D142,685 | S | 10/1945 | Zinkel | |
| 2,547,840 | A | 4/1951 | Smith | |
| 2,706,821 | A | 4/1955 | Griggs | |
| 3,112,956 | A | 12/1963 | Schick et al. | |
| 4,329,747 | A | 5/1982 | Russell | |
| 4,454,615 | A | 6/1984 | Whitney | |
| 4,985,952 | A | 1/1991 | Edelson | |
| 5,097,552 | A | 3/1992 | Viesturs | |
| D376,945 | S | 12/1996 | Bonaddio et al. | |
| 6,009,579 | A | 1/2000 | Pedersen | |
| 6,223,367 | B1 | 5/2001 | French et al. | |
| 6,684,436 | B1 | 2/2004 | Lovelace | |
| 6,701,559 | B2 | 3/2004 | Boso et al. | |
| 6,754,925 | B1 | 6/2004 | Wang | |
| 6,922,863 | B2 | 8/2005 | Giori et al. | |
| 6,951,039 | B2 * | 10/2005 | Roseff | 5/706 |
| 7,007,329 | B2 | 3/2006 | Metzger | |
| 2002/0133879 | A1 * | 9/2002 | Smith et al. | 5/413 R |
| 2002/0166168 | A1 | 11/2002 | Weedling et al. | |
| 2004/0154105 | A1 | 8/2004 | Roseff | |
| 2006/0253991 | A1 | 11/2006 | McClintock | |

FOREIGN PATENT DOCUMENTS

| | | | |
|---|---|---|---|
| CH | 164789 | A | 10/1993 |

(Continued)

OTHER PUBLICATIONS

U.S. Appl. No. 11/220,443, filed Aug. 9, 2005, Rockstad.

(Continued)

*Primary Examiner*—Fredrick Conley
(74) *Attorney, Agent, or Firm*—Townsend and Townsend and Crew LLP

(57) ABSTRACT

An airbed with an integral sleeve. After deflation of the airbed, the airbed is rolled or folded into a tight formation, and the sleeve is extended around the airbed for storage. The sleeve may be a flat fabric material that is attached to a seam of the airbed, for example by welding. The sleeve includes drawstrings or cords for tying and tightening the sleeve around the airbed. A handle may also be provided for carrying the stored airbed once the sleeve is in place.

12 Claims, 2 Drawing Sheets

FOREIGN PATENT DOCUMENTS

| | | | |
|---|---|---|---|
| DE | 29616616 | U1 | 12/1997 |
| EP | 0146856 | A2 | 7/1985 |
| JP | 03097417 | A | 4/1991 |
| JP | 05056828 | A | 9/1993 |
| JP | 07124202 | A | 5/1995 |
| WO | WO 94/15503 | A1 | 7/1994 |

OTHER PUBLICATIONS

"Queen Mattress (Stackable Twin) with Pillow Set," *Bestway 2003 Catalog: Rhode Island Novelty*, p. 79 (2003).

European Patent Office International Search Report from counterpart PCT Application No. PCT/US2006/017272, (Sep. 13, 2006).

* cited by examiner

SELF-STORING AIRBED

TECHNICAL FIELD OF THE INVENTION

The present invention is directed to inflatable products, and more specifically to airbeds.

BACKGROUND OF THE INVENTION

An airbed is a large rectangular rubber or plastic (e.g., vinyl) bag that is filled with air so that it may be used as a bed. Airbeds are well known in the art and have proven themselves to be very useful. On the one hand, an inflatable airbed may be deflated and folded to store the airbed in a closet or basement. On the other hand, when guests arrive or when the owner of the airbed takes a trip to a place where there is no bed, the airbed may be inflated and may be used as a bed.

An air mat is similar in construction to an airbed, but is used as a float so that an individual may lie on the air mat in the water. Both products fall under the broad category of "inflatable" products. Other nonlimiting examples of inflatable products include rafts, inflatable furniture, inflatable pools, and inflatable boats.

One problem often encountered with inflatable products such as airbeds is that they are difficult to store. For example, often, an airbed is shipped in a box, and storing the airbed in the box is difficult, if not impossible. When the airbed is shipped, there is almost no air at all in the airbed, and it is efficiently folded so as to fit in the box. A user may find it difficult to remove all air from the airbed, and/or replicate the folding pattern used in shipping of the product. Thus, the user typically folds the airbed as tightly as possible and extends it partly into the box, with a portion hanging out. Even if the user can get the airbed back into the box, the box may become crushed, torn, broken, or otherwise damaged with use. If a box is not used, the user must store the airbed in a different manner, such as in a separate bag or using ties.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, an airbed or inflatable product is provided with an integral sleeve. After deflation of the airbed, the airbed is rolled or folded into a tight formation, and the sleeve is extended around the airbed for storage.

In accordance with an embodiment, the sleeve is a flat fabric material that is attached to a seam of the airbed, for example by welding.

In accordance with an embodiment, the sleeve includes drawstrings or cords for tying and tightening the sleeve around the airbed. A handle may also be provided for carrying the stored airbed once the sleeve is in place.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
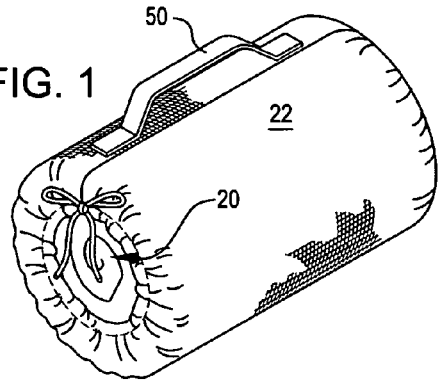
FIG. 1 is side perspective view of an airbed with the airbed stored in a sleeve in accordance with an embodiment of the invention.

Referring now to the drawings, in which like reference numerals represent like parts throughout the several views, FIG. 1 shows an airbed 20 encased by a sleeve 22 in accordance with an embodiment of the invention. Briefly described, the sleeve 22 is attached to the airbed 20 and is configured so that it may extend around and enclose the airbed 20 when air is deflated from the airbed and the airbed is rolled or folded into a tight configuration. In general, the present invention is directed to a sleeve, such as the sleeve 22, for use an inflatable product such as the airbed 20, but sleeves in accordance with the invention may be utilized with other inflatable products including, but not limited to, air mats, rafts, inflatable furniture, inflatable pools, inflatable boats, and other inflatable products.

Figure 2:
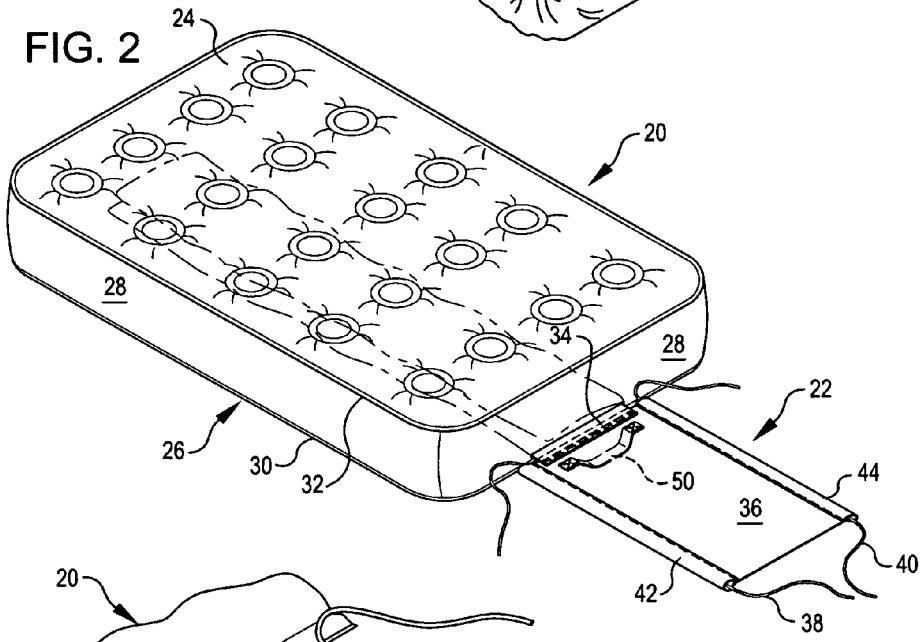
FIG. 2 is a side perspective view of the airbed of FIG. 1, with the airbed in a deployed position and the sleeve rolled out flat.

FIG. 2 shows the airbed 20 fully inflated. The airbed 20 includes a top wall 24, a bottom wall 26, and a side wall 28 joining the top wall and bottom wall. Together the top wall 24, the bottom wall 26, and the side wall 28 form an airtight mattress. The side wall 28 is connected to the bottom wall 26 at a lower seam 30. This lower seam 30 may be, for example, a weld. Similarly, the top wall 24 is attached to the side wall 28 at an upper seam 32.

Figure 3:
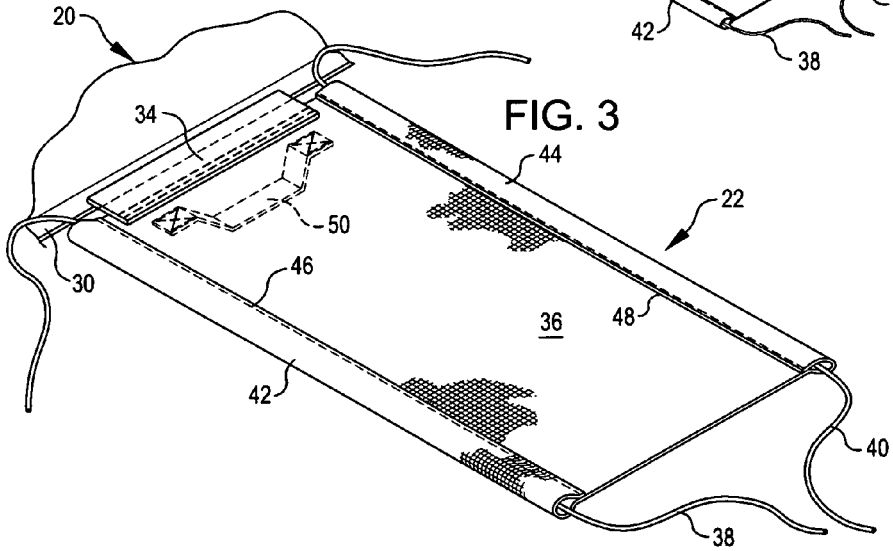
FIG. 3 is a side perspective view of the sleeve for the airbed of FIG. 1.

Details of the sleeve 22 are shown in FIG. 3. In the embodiment shown, a strip 34 attaches to the lower seam 30. This strip 34 is preferably sewn or otherwise permanently affixed to the lower seam 30. The strip 34 is preferably formed of a material so that it may be welded, heat-fused, or otherwise formed as a portion of the airbed 20. Although shown as attached to the lower seam 30, the strip 34 or other parts of the sleeve 22 may alternatively be attached to A rectangular fabric 36 is attached to the strip 34. The rectangular fabric 36 is preferably wider than the strip 34, and is of sufficient length to wrap around the airbed 20 when the airbed is folded or rolled into a storage configuration, such as is shown in FIG. 1.

Cords 38, 40 extend along the side edges of the rectangular fabric 36 within channels 42, 44 formed in the fabric by sew lines 46, 48. These cords 38, 40 are free to slide within the channels 42, 44, but alternatively may be fixed in one position, such as by sewing a stitch through the rectangular fabric 36 into each cord 38 and 40.

In the embodiment shown in FIG. 3, a handle 50 is provided on the underside of the rectangular fabric 36 at a position near the strip 34. This handle 50 is arranged on the outside of the sleeve 22 when the sleeve 22 encases the airbed 20, as can be seen in FIG. 1.

Figure 4:
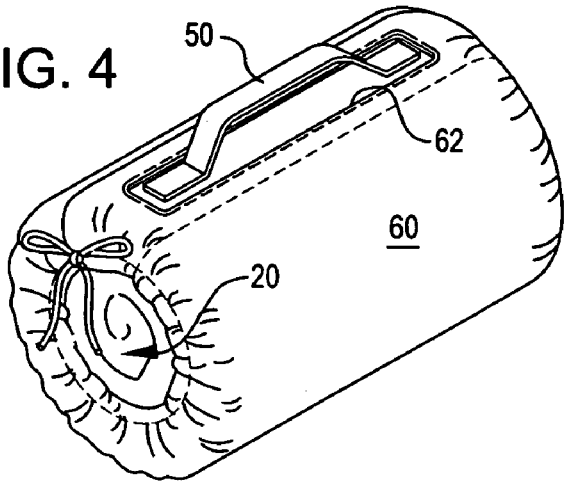
FIG. 4 is an alternate embodiment of a sleeve that may be used to store an airbed, with the sleeve shown encasing an airbed.

An alternate embodiment is shown in FIG. 4, wherein a sleeve 60 includes an opening 62 at its outer end. The sleeve in this embodiment is longer than the sleeve 22, and wraps more than once around the rolled airbed 20. When extended beyond the handle 50, the opening 62 extends over and around the handle 50. Thus, access to the handle 50 is still provided, and any pulling on the handle 50 is restrained from sliding the sleeve 60 by the opening 62 engaging the handle 50.

In use, the airbed 20 is deflated and then rolled or folded into a compressed state. In an embodiment, the airbed is rolled so that it forms a cylinder. The cylinder is preferably narrower than the width of the rectangular fabric 36, and wider than the strip 34.

Figure 5:
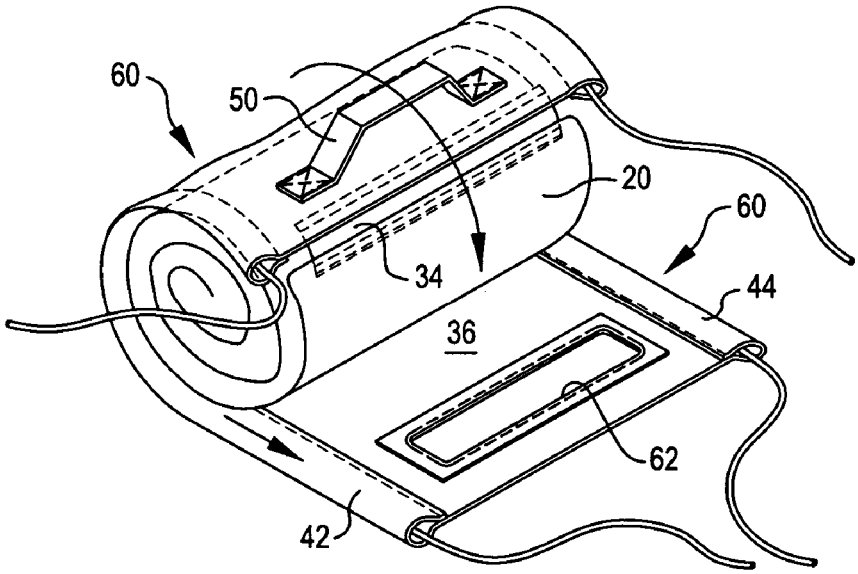
FIG. 5 is a side perspective view of the sleeve of FIG. 4, with the sleeve partially rolled around the airbed.

After the airbed 20 has been rolled or folded into a compressed configuration, the sleeve 22 or 60 is pulled upward around the rolled airbed and then extended around the airbed. An example of a rolled configuration of the airbed 20 is shown in FIG. 5. The sleeve 60 is shown partly extended around the rolled airbed 20 in FIG. 5.

After the sleeve 22 is fully extended around the airbed 20, the cords 38, 40 are pulled tight and the ends of each cord are tied together so as to tighten the sleeve 22 about the ends of and around the airbed. In alternate embodiments, the cords are replaced with snaps, hook and loop fasteners, clips, clasps, hooks, or other suitable fasteners or fastening structures.

In a finished state, the sleeve 22 or 60 surrounds the airbed 20, as is shown in FIGS. 1 and 5. The handle 50 is presented on the outside of the sleeve 22 and may be used for transporting the airbed 20.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An airbed, comprising:

a top, a bottom, and sides forming a mattress, the sides including a right side, a left side, a head end, and a foot end, the mattress being capable of being at least one of rolled or folded into a storage configuration, the storage configuration defining first and second opposite sides; and a sleeve attached to the mattress, the sleeve comprising a flap of flexible material with first and second cinch mechanisms along opposite sides of the flexible material, the sleeve being configured to wrap around the mattress with the first cinch mechanism aligned outside and beyond the first side of the mattress, and the second cinch mechanism aligned outside and beyond the second side of the mattress, the cinch mechanisms being configured so that the first cinch mechanism is cinched about the first side of the mattress so as to enclose the first side, and the second cinch mechanism is cinched about the second side of the mattress so as to enclose the second side so that the flap of flexible material encases at least a portion of the mattress when the mattress is in the storage configuration.

2. The airbed of claim 1, wherein the sleeve is attached to the mattress at the foot end side of the mattress.

3. The airbed of claim 1, further comprising a lower seam between the sides and the bottom, and wherein the sleeve is attached to the lower seam.

4. The airbed of claim 3, wherein the sleeve is attached to the lower seam by welding or heat-fusing.

5. The airbed of claim 4, wherein the flap of flexible material comprises a fabric, and further comprising a strip between the lower seam and the fabric, the strip being attached by welding or heat-fusing.

6. The airbed of claim 5, wherein the fabric is wider than the strip.

7. The airbed of claim 5, wherein each of the cinching mechanisms comprises a cord extended along a side edge of the fabric and received in a channel formed in the fabric.

8. The airbed of claim 1, wherein each of the cinching mechanism comprises a cord extended along a side edge of the fabric and received in a channel formed in the fabric.

9. The airbed of claim 1, further comprising a handle on the outside of the sleeve.

10. The airbed of claim 9, wherein the sleeve includes an opening, and wherein the sleeve extends around the airbed and over the handle and the handle is accessible through the opening.

11. A method of storing an airbed, comprising:

deflating the airbed;

at least one of rolling or folding the airbed into a storage configuration, the storage configuration defining first and second opposite sides;

wrapping a sleeve connected to the airbed around the airbed, the sleeve comprising a flap of flexible material with first and second cinch mechanisms along opposite sides of the flexible material, the flap of flexible material being wrapped around the airbed so as to at least partially enclose the airbed and so that the first cinch mechanism is aligned outside and beyond the first side of the airbed, and the second cinch mechanism is aligned outside and beyond the second side of the airbed; and fastening the sleeve around the airbed by cinching the first cinch mechanism about said one side of the airbed so as to enclosed the flap around the first end, and cinching the second cinch mechanism about the opposite side so as to enclose the flap around the second end.

12. The method of claim 11, wherein the sleeve is connected to a foot end of the airbed.

* * * * *